US007294166B2

(12) United States Patent
Otani et al.

(10) Patent No.: US 7,294,166 B2
(45) Date of Patent: Nov. 13, 2007

(54) METAL-GRAPHITE BRUSH

(75) Inventors: Takayoshi Otani, Ise Mie (JP); Mitsuo Ikeda, Matsusaka Mie (JP); Yoichi Sakaura, Matsusaka Mie (JP); Naoki Morita, Matsusaka Mie (JP); Kyoji Inukai, Toyota (JP); Youichi Murakami, Aichi (JP); Yasuyuki Wakahara, Kariya (JP); Masami Niimi, Handa (JP)

(73) Assignees: Tris Inc., Matsusaka Mie (JP); Denso Corporation, Aichi (JP)

( * ) Notice: Subject to any disclaimer, the term of this patent is extended or adjusted under 35 U.S.C. 154(b) by 967 days.

(21) Appl. No.: 10/279,776

(22) Filed: Oct. 24, 2002

(65) Prior Publication Data

US 2006/0087197 A1 Apr. 27, 2006

(30) Foreign Application Priority Data

Oct. 25, 2001 (JP) ..... 2001-327537

(51) Int. Cl.
*C22C 1/05* (2006.01)
*H01R 39/20* (2006.01)
*H01R 39/22* (2006.01)

(52) U.S. Cl. ..... 75/231; 310/251; 310/252

(58) Field of Classification Search ..... 75/231; 310/251, 252

See application file for complete search history.

(56) References Cited

U.S. PATENT DOCUMENTS

| | | | | |
|---|---|---|---|---|
| 2,777,081 | A * | 1/1957 | Miner, Jr. | 310/228 |
| 3,300,667 | A | 1/1967 | Boes et al. | |
| 3,302,270 | A * | 2/1967 | Grabbe | 29/597 |
| 3,303,370 | A | 2/1967 | Boes et al. | |
| 3,601,645 | A * | 8/1971 | Whiteheart | 310/219 |
| 5,270,504 | A | 12/1993 | Grohs et al. | |
| 6,755,882 | B2 * | 6/2004 | Otani et al. | 75/231 |

FOREIGN PATENT DOCUMENTS

| | | |
|---|---|---|
| FR | 1 421 506 A | 12/1965 |
| GB | 836 984 A | 6/1960 |
| GB | 836984 | 6/1960 |
| JP | 55-56795 A | 4/1955 |
| JP | 58-51483 A | 3/1983 |
| JP | 58-121582 A | 7/1983 |
| JP | 8-96916 A | 4/1996 |
| JP | 2000-144202 | 5/2000 |

OTHER PUBLICATIONS

European Search Report for Application No. EP 02 02 3827, dated May 26, 2004.

* cited by examiner

*Primary Examiner*—Roy King
*Assistant Examiner*—Ngoclan T. Mai
(74) *Attorney, Agent, or Firm*—The Webb Law Firm

(57) ABSTRACT

A brush body 4 of a metal-graphite brush 2 is composed of a commutator side portion 6 which contains graphite, copper and a metal sulfide solid lubricant, and a lead side portion 8 which contains graphite and copper but does not contain any metal sulfide solid lubricant. A lead wire 10 is attached to the lead side portion 8 containing no metal sulfide solid lubricant.

7 Claims, 3 Drawing Sheets

2

METAL-GRAPHITE BRUSH

FIELD OF THE INVENTION

The present invention relates to metal-graphite brushes which are used in electrical motors for automobiles, etc, and in particular, Pb-less metal-graphite brush.

PRIOR ART

Metal-graphite brushes have been used as brushes for low-voltage operation, such as brushes for electrical motors in automobiles. They are produced by mixing graphite and a metal powder such as copper powder, molding and sintering the mixture. As operated at low voltages, their resistivities are lowered by adding a low resistance metal powder. A metal sulfide solid lubricant, such as molybdenum disulfide or tungsten disulfide, and Pb are added to metal-graphite brushes in many cases. For example, in brushes for heavy load such as brushes for starting motor, Pb and a metal sulfide solid lubricant are added in most of the cases.

In recent years, Pb has been attracting greater attention as one of materials damaging to the environment, and there is a growing demand for Pb-less brushes. Of course, brushes containing no lead have been available up to the present and they have been used in some motors other than starting motors. Even some brushes for starting motors can be used by simply eliminating Pb from them, provided that they are used under normal service environments. To improve the lubricating properties without Pb, Japanese Patent Opening Hei 5-226048 (U.S. Pat. No. 5,270,504) proposes that a metal having a melting point lower than that of copper is mixed in such a way that copper and the metal do not form an alloy. The present inventors, however, found that in metal-graphite brushes wherein a metal sulfide solid lubricant is added to copper and graphite, the elimination of Pb results in an increase in the lead connection resistance under high temperature or high humidity.

SUMMARY OF THE INVENTION

The initial object of the present invention is to control the increase in the lead connection resistance of a Pb-less metal-graphite brush even under high temperature or high humidity.

In the present invention, a metal-graphite brush comprising a copper-graphite brush body to which a metal sulfide solid lubricant is added and a lead embedded in the copper-graphite brush body is characterized in that a concentration of the metal sulfide solid lubricant in the copper-graphite brush body is made different between in a neighborhood of the lead in the copper-graphite brush body and a portion of the copper-graphite brush body with which a commutator of a rotational electric armature is to be in contact and that a concentration of the metal sulfide solid lubricant in the neighborhood of the lead in the copper-graphite brush body is lower than a concentration of the metal sulfide solid lubricant in the portion of the copper-graphite brush body in contact with the commutator.

Preferably, the concentration of the metal sulfide solid lubricant in the neighborhood of the lead in the copper-graphite brush body is less than 1 wt %.

More preferably, the concentration of the metal sulfide solid lubricant in the neighborhood of the lead in the copper-graphite brush body is substantially 0%. "Substantially 0%" herein means 0.1 wt % or under, which is the upper limit of the contamination level of the metal sulfide solid lubricant.

Preferably, the metal sulfide solid lubricant is at least a member of a group comprising molybdenum disulfide and tungsten disulfide.

Preferably, the concentration of the metal sulfide solid lubricant in the portion of the copper-graphite brush body in contact with the commutator is from 1 to 5 wt %.

Preferably, the lead is a non-electroplated copper lead in form of a stranded wire, a braided wire, etc.

Preferably, the neighborhood of the lead in the copper-graphite brush body and the portion of the copper-graphite brush body in contact with the commutator are made of different powder materials in concentrations of the metal sulfide solid lubricant and shaped in a common mold.

More preferably, the powder materials are further different in copper concentrations and that the copper concentration of the neighborhood of the lead is higher than the copper concentration of the portion.

The kind of the metal-graphite brush is the molded brush wherein the top end of the lead is embedded in the brush body, for example, at the time of molding the brush body and the brush body and the lead are molded integrally.

According to the experiments by the present inventors, the increase in the lead connection resistance under high temperature or high humidity is attributed to the metal sulfide solid lubricant. When the metal sulfide solid lubricant was not added, the lead connection resistance did not increase substantially even under high temperature or high humidity. This is related to the presence or absence of Pb. When Pb was added, the lead connection resistance hardly increased in such conditions. In Pb-less brushes, in correspondence with the increase in the lead connection resistance, the copper powder and the lead embedded in the brush body showed a greater tendency to be oxidized under high temperature or high humidity.

The metal sulfide solid lubricant such as molybdenum disulfide or tungsten disulfide is added by the designer of the brush, but the metal sulfide solid lubricant is indispensable to brushes so as to have a long service life. Without metal sulfide solid lubricant, an excessive wear may be generated. In particular, this phenomenon is conspicuous in starter brushes to which Pb has been added. When Pb and the metal sulfide solid lubricant are eliminated simultaneously, the service life of the brush will be reduced significantly. Hence in many cases, the metal sulfide solid lubricant can not be eliminated from Pb-less brushes.

The present inventors estimated the mechanism by which the metal sulfide solid lubricant accelerates the oxidization of the copper powder and the embedded lead under high temperature or high humidity as follows: At the time of sintering the brushes, sulfur is liberated from the metal sulfide solid lubricant added to the brush and sulfur adsorbes on the surface of copper to produce copper sulfide. If moisture acts on copper sulfide under high humidity, strongly acidic copper sulfate will be produced to corrode severely the copper powder and the lead. Although the behavior of copper sulfide under high temperature is not certain in some aspects, it is estimated that copper sulfide is oxidized to increase the electrical resistance.

The mechanism by which Pb prevents the oxidization of the copper powder in the brush and the embedded lead is not known exactly. The present inventors estimate that Pb contained in the brush partially evaporates at the time of sintering and coats the surface of copper in the form of a very thin Pb layer. And this Pb layer protects the inner copper from sulfate ion, etc.

According to the present invention, the concentration of the metal sulfide solid lubricant in the neighborhood of the lead in the brush body is lower than that in the portion of the brush body in contact with the commutator, hence the lead and the nearby copper powder in the brush body can be protected from sulfate ion derived from the metal sulfide solid lubricant, and in turn, the increase in the lead connection resistance under high temperature or high humidity can be prevented.

Moreover, according to the present invention, different materials are used to produce the portion in the neighborhood of the lead in the brush body and the portion of the brush body in contact with the commutator, respectively. The material of the portion other than the portion in the neighborhood of the lead can be freely selected to meet requirements such as wear resistance, and in turn, Pb-less brushes can be designed more easily.

The increase in the lead connection resistance due to the metal sulfide solid lubricant becomes significant in concentrations exceeding 1 wt %. Hence the increase in the lead connection resistance can be easily controlled by reducing the concentration of the metal sulfide solid lubricant in the neighborhood of the lead in the brush body to less than 1 wt %.

Naturally, when the concentration of the metal sulfide solid lubricant in the neighborhood of the lead in the brush body is substantially reduced to 0%, namely, when the concentration of the metal sulfide solid lubricant is reduced to the contamination level or under, the increase in the lead connection resistance under high temperature or high humidity can be prevented more reliably.

The metal sulfide solid lubricant is preferably molybdenum disulfide or tungsten disulfide, or a mixture of them, from the viewpoints of cost and lubrication performance at high temperatures.

Preferably, the concentration of the metal sulfide solid lubricant is from 1 to 5 wt %. If its concentration is less than 1 wt %, sufficient lubrication can not be obtained, and if its concentration is over 5 wt %, an increase in the resistivity will be resulted, in short, bad effects on the brush performance will be generated.

The material of the lead is not limited to copper wire. For a lead using non-electroplated copper wire, prevention of oxidization by the metal sulfide solid lubricant is of particular importance. In the brush production, both the lead and the brush body are sintered together at the same time. Accordingly, even when the lead is an electroplated one, for example, a copper lead electroplated with silver or nickel, the lead is subjected to sintering at high temperatures, the copper inside the lead will be alloyed with the electroplating material and diffuse on the surface of the lead, and in turn, prevention of its oxidization will be needed.

From the viewpoint of easier production, it is preferable to divide the brush body into two parts, namely, the portion of the brush body in contact with the commutator and the portion in the neighborhood of the lead in the brush body and to shape them in a common mold.

When the copper concentration is higher in the neighborhood of the lead than in the portion in contact with the commutator, the lead connection resistance will be desirably reduced.

Even in brushes without Pb addition, in many cases, Pb is still contained in electrolytic copper, a normal copper material for metal-graphite brushes, as an impurity. Moreover, in the production of brushes, if Pb-less brushes and brushes containing Pb are produced by the same facilities, a small amount of Pb will enter, as a contamination, into the Pb-less brushes. However, in the Pb-less brushes, the Pb concentration in the brush body does not generally exceed 0.2 wt %. Similarly, when a metal sulfide solid lubricant such as molybdenum disulfide or tungsten disulfide is added, contamination by the solid lubricant to brushes without them can not be avoided in the production, and a trace of the metal sulfide solid lubricant may be contained in the neighborhood of the lead in the brush body to which no metal lubricant is added. However, in the case of contamination, the concentration of the metal sulfide solid lubricant in the neighborhood of the lead in the brush body will not exceed 0.1 wt %.

EMBODIMENTS

Figure 1:
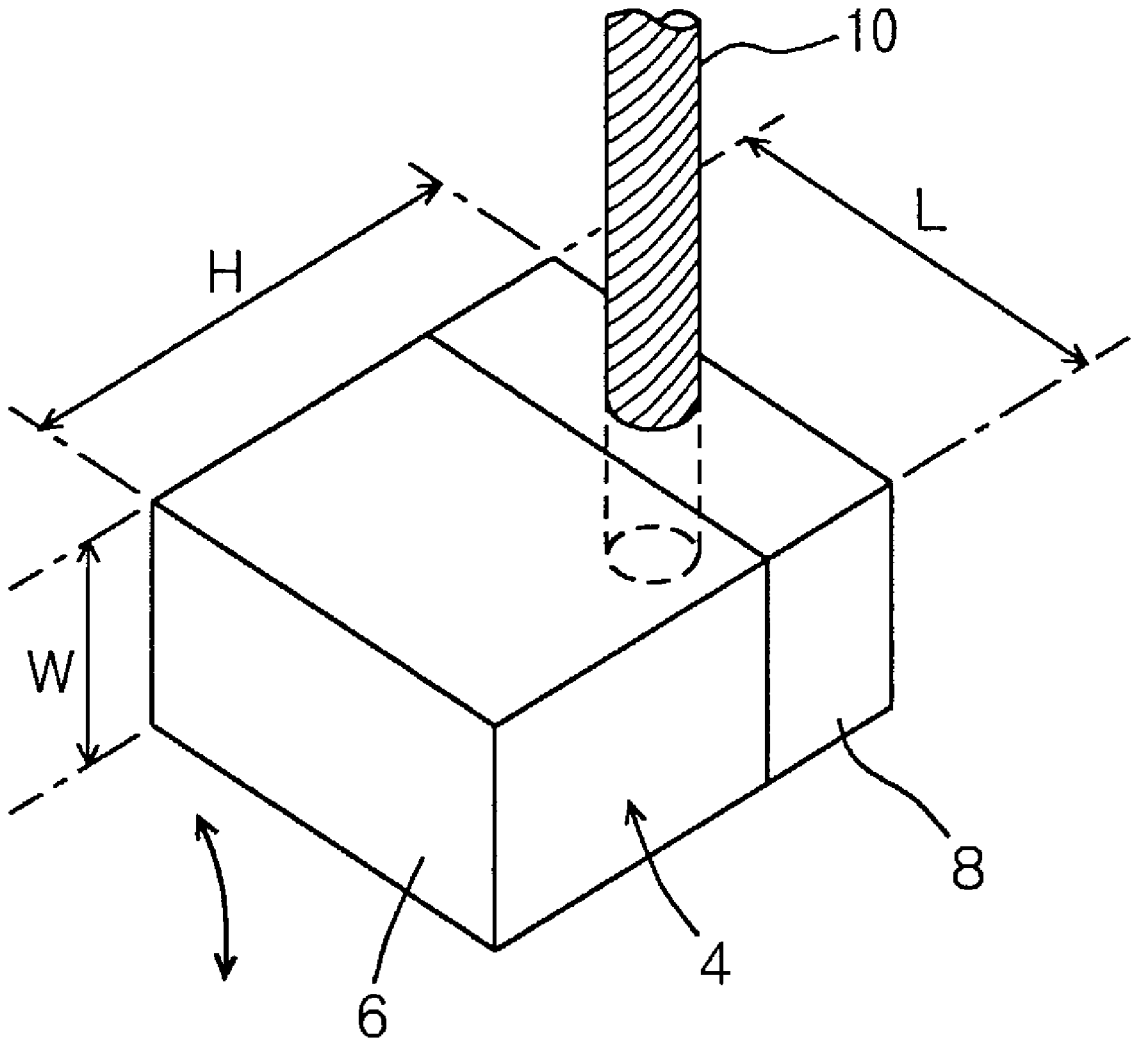
FIG. 1 is a perspective view of a metal-graphite brush of an embodiment.

FIG. 1 through FIG. 4 show the structure and the production method of the brush. FIG. 1 shows a metal-graphite brush 2 of the embodiment, and in the following, the metal-graphite brush is simply referred to as the brush. The brush is used, for example, as a brush of electrical motors in automobiles, such as a brush of a starting motor. 4 denotes a brush body. 6 denotes a commutator side portion, which makes sliding contact with the commutator of a rotational electric armature such as a starting motor. 8 denotes a lead side portion, in which a lead wire 10 is embedded and fixed. The sliding direction of the commutator is schematically shown by an arrow near the commutator side portion 6 in FIG. 1.

The concentration of the metal sulfide solid lubricant in the commutator side portion 6 is different from that in the lead side portion 8. The concentration in the lead side portion 8 is less than 1 wt %, and preferably, no metal sulfide solid lubricant is added. If the boundary between the commutator side portion 6 and the lead side portion 8 is not clear, the brush 2 is, for example, cut and, the concentration of the metal sulfide solid lubricant in the brush material near the lead wire 10 is defined as the concentration of the metal sulfide solid lubricant in the lead side portion. As for the concentration of copper in the brush material, if the copper concentration in the lead side portion 8 is higher than that in the commutator side portion 6, the lead connection resistance can be reduced. The lead wire 10 may be a copper wire electroplated with nickel or silver or the like. However, a copper lead wire, which is made by stranding nonelectroplated copper wires, is used because oxidization by the metal sulfide solid lubricant can be prevented efficiently according to the embodiment.

Figure 2:
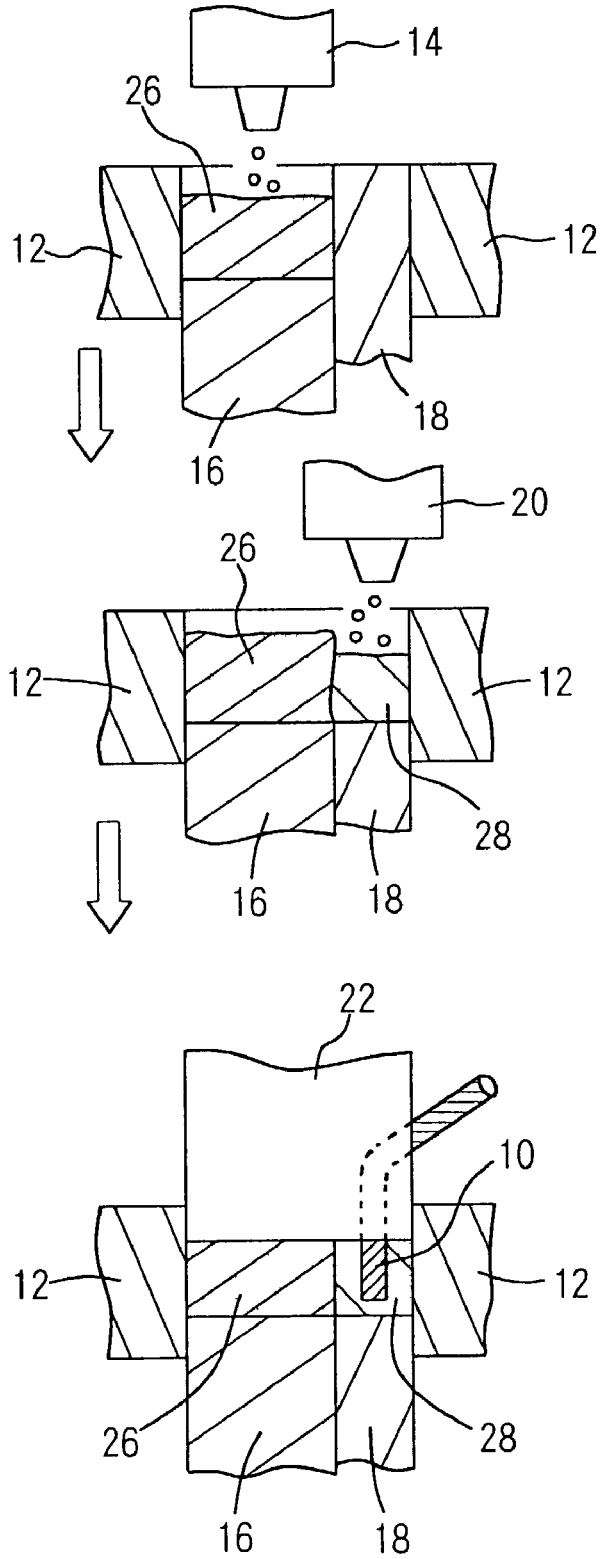
FIG. 2 shows schematically the molding process of the metal-graphite brush of the embodiment.

The production of the brush 2, as an example, shown in FIG. 2. A fixed die 12 is provided with, for example, a pair of lower movable dies 16, 18. A portion corresponding to the lead side portion is first blocked by the lower movable die 18. Then a powder material 26 for the commutator side portion, which is larger in volume, is fed from a first hopper 14. Next, the lower movable die 18 is retracted, and a powder material 28 for the lead side portion is fed from a second hopper 20. Then an upper movable die 22 with the lead wire 10 being drawn out of the top end thereof is lowered to effect molding. In this way, both the commutator side portion and the lead side portion are molded integrally, they are sintered in a reducing atmosphere or the like, and the brush 2 will be obtained.

Figure 3:
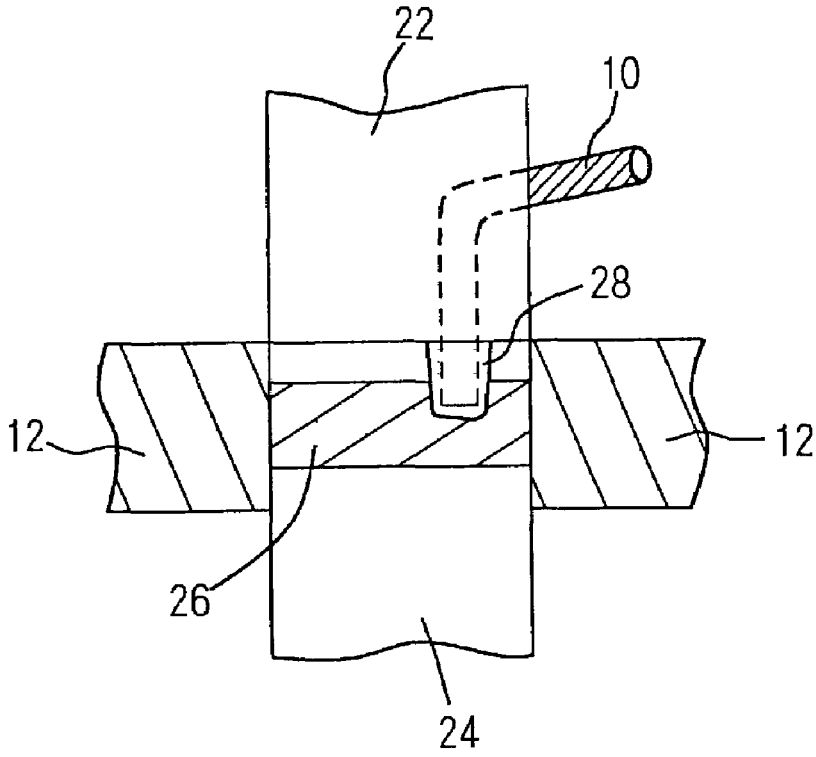
FIG. 3 shows the molding process of the metal-graphite brush of a modification, where a lead to which a lead side powder material is pre-adhered is embedded into a powder material for a commutator side portion.

FIG. 3 shows the production of the brush of the modification. The powder material 26 for the commutator side portion is fed onto a lower movable die 24 from a hopper not illustrated. Next, the lead wire 10, with the powder material 28 for the lead side portion adhering to an embedded portion thereof, is embedded by the upper movable die 22 into the powder material 26, and simultaneously with this, the powder material 26 and the lead wire 10 are pressed by the upper movable die 22 to be molded integrally. To make the powder material 28 adhere to the lead wire 10, for example, a mixed powder of graphite and copper powder is dispersed in a phenol resin binder solution or the like, and the embedded portion of the lead wire 10 is immersed in the solution.

Figure 4:
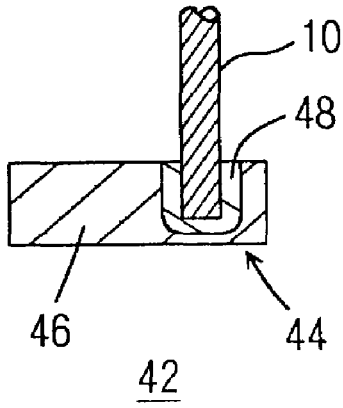
FIG. 4 is a sectional view of the metal-graphite brush of the modification.

FIG. 4 shows a metal-graphite brush 42 obtained by the manner as shown in FIG. 3. 44 denotes a brush body, 46 denotes a commutator side portion, and 48 denotes a lead side portion. Of course, the configuration and the method of production of the brush themselves are discretionary.

In the following, the embodiment will be described more specifically. The configuration of the brush is one shown in FIG. 1. The height H of the brush body 4 is 13.5 mm, the length L thereof is 13 mm, and the width W thereof is 6.5 mm. The lead wire 10 is a stranded nonelectroplated copper wires. It may be a braided wire. The diameter of the lead wire 10 is 3.5 mm, and the depth of its embedded portion is 5.5 mm. The ratio of the height of the commutator side portion 6 and that of the lead side portion 8 is, for example, about 3:2.

Embodiment 1

Twenty parts by weight of novolak type phenol resin being dissolved in 40 parts by weight of methanol were mixed with 100 parts by weight of natural flaky graphite. They were homogeneously mixed up by a mixer, and methanol was dried out of the mixture by a drier. The residue was crushed by an impact crusher and sieved with a sieve of 80 mesh pass (a 198 μm pass sieve) to obtain resin finished graphite powder. Sixty parts by weight of electrolytic copper, of which mean particle size was 30 μm, and 3 parts by weight of molybdenum disulfide were respectively added to 37 parts by weight of the resin finished graphite powder. They were homogeneously mixed by a V type mixer to obtain the powder material 26 for the commutator side portion 6. Seventy parts by weight of electrolytic copper, of which mean particle size was 30 μm, were added to 30 parts by weight of the resin finished graphite, and they were homogeneously mixed by the V type mixer to obtain a powder material 28 for the lead side portion. These powder materials were integrally molded under the pressure of $4\times10^8$ Pa ($4\times9800$ N/cm$^2$), as shown in FIG. 2, and the molding was sintered in a reducing atmosphere in an electric furnace at 700° C. to obtain the brush of embodiment 1.

Embodiment 2

69.5 parts by weight of electrolytic copper, of which mean particle size was 30 μm, and 0.5 part by weight of molybdenum disulfide were added to 30 parts by weight of the resin finished graphite which was used in embodiment 1. They were homogeneously mixed in the V type mixer to obtain a powder material 28. The powder material 26 for the commutator side portion was the same as that of embodiment 1, and other conditions were the same as those of embodiment 1. After molding and sintering, the brush of embodiment 2 was obtained.

Embodiment 3

69.2 parts by weight of electrolytic copper, of which mean particle size was 30 μm, and 0.8 part by weight of molybdenum disulfide were added to 30 parts by weight of the resin finished graphite which was used in embodiment 1. They were homogeneously mixed in the V type mixer to obtain a powder material 28. The powder material 26 was the same as that of embodiment 1, and other conditions were the same as those of embodiment 1. After molding and sintering, a brush of embodiment 3 was obtained.

Comparative Example 1

Sixty parts by weight of electrolytic copper, of which mean particle size was 30 μm, 3 parts by weight of molybdenum disulfide and 2 parts by weight of Pb powder were added to 35 parts by weight of the resin finished graphite used in embodiment 1. They were homogeneously mixed in the V type mixer to obtain a powder material. This powder material was used for both the commutator side portion and the lead side portion, commonly, for the entire brush. The powder material was molded under the pressure of $4\times10^8$ Pa and the molding was sintered in a reducing atmosphere in an electric furnace at 700° C. to obtain a brush of comparative example 1. This brush was a brush containing Pb, which was produced by the conventional ordinary brush production method.

Comparative Example 2

Sixty parts by weight of electrolytic copper, of which mean particle size was 30 μm, and 3 parts by weight of molybdenum disulfide were added to 37 parts by weight of the resin finished graphite which was used in embodiment 1. They were homogeneously mixed in the V type mixer to obtain a powder material. This powder material was molded and sintered in the same manner as comparative example 1 to obtain a brush of comparative example 2. This brush was a conventional Pb-less brush.

Comparative Example 3

Sixty-eight parts by weight of electrolytic copper, of which mean particle size was 30 μm, and 2 parts by weight of molybdenum disulfide were added to 30 parts by weight of the resin finished graphite which was used in embodiment 1. They were homogeneously mixed in the V type mixer to obtain a powder material 28 for the lead side portion 8. The powder material 26 for the commutator side portion 6 was the same as that of embodiment 1. Other conditions were the same as those of comparative example 1 and the powder materials were molded and sintered to obtain a brush of comparative example 3.

Comparative Example 4

Sixty-seven parts by weight of electrolytic copper, of which mean particle size was 30 μm, and 3 parts by weight of molybdenum disulfide were added to 30 parts by weight of the resin finished graphite of embodiment 1. They were homogeneously mixed in the V type mixer to obtain a powder material 28 for the lead side portion 8. The powder material for the commutator side portion was the same as that of embodiment 1. Other conditions of the method were the same as those of embodiment 1 and the powder materials were molded and sintered to obtain a brush of comparative example 4.

The content (concentration) of the metal sulfide solid lubricant in each of the above-mentioned brushes, on calculation, increases a little in comparison with the concentration based on the mixing because novolak type phenol resin is partly decomposed and lost at the time of sintering. The calculated increase in the concentration, however, is within the margin of error. Table 1 shows the contents of the metal sulfide solid lubricants in the lead side portions of embodiments 1 through 3 and comparative examples 1 through 4. Zero percent (0%) content in Table 1 indicates that the material is not added and practically it is not contained. It does not indicate the content of the impurity is 0.

TABLE 1

Contents of the metal sulfide solid lubricant in lead side portions

| Sample | $MoS_2$ content (%) | Pb content (%) |
|---|---|---|
| Embodiment 1 | 0 | 0 |
| Embodiment 2 | 0.5 | 0 |
| Embodiment 3 | 0.8 | 0 |
| Comparative example 1 | 3.1 | 2.0 |
| Comparative example 2 | 3.1 | 0 |

TABLE 1-continued

Contents of the metal sulfide solid lubricant in lead side portions

| Sample | $MoS_2$ content (%) | Pb content (%) |
|---|---|---|
| Comparative example 3 | 2.0 | 0 |
| Comparative example 4 | 3.1 | 0 |

Brushes of embodiments 1 through 3 and comparative examples 1 through 4 were put in an electric oven at 200° C. and forced to be oxidized, and their lead connection resistances were measured periodically. Changes in the lead connection resistances resulting from the exposure to 200° C. are shown in Table 2. Furthermore, brushes of embodiments 1 through 3 and comparative examples 1 through 4 were put in a constant-temperature & constant-humidity vessel of 80° C. and relative humidity of 85% to expose them to the high humidity and force copper therein to be oxidized, and their lead connection resistances were measured periodically. The changes in the lead connection resistances in the high humidity are shown in Table 3. The number of measurements was ten for each, and the arithmetic mean was used. The measurement of the lead connection resistance was made in accordance with the method described in "Method of Testing the Lead connection Resistance of Brushes for Electrical Machines" of Japan Carbon Associates Standards, JCAS-12-1986.

TABLE 2

Changes in lead connection resistances resulting from exposure to 200° C.

| Sample | Lead connection resistance (unit: mV/10 A) | | | | | | | | |
|---|---|---|---|---|---|---|---|---|---|
| Number of days | Initial value | 1 | 2 | 3 | 4 | 5 | 7 | 10 | 15 |
| Embodiment 1 | 0.81 | 0.83 | 0.83 | 0.84 | 0.85 | 0.87 | 0.91 | 0.99 | 1.10 |
| Embodiment 2 | 0.82 | 0.85 | 0.86 | 0.88 | 0.91 | 0.93 | 0.95 | 1.01 | 1.12 |
| Embodiment 3 | 0.83 | 0.85 | 0.88 | 0.90 | 0.92 | 0.95 | 0.98 | 1.08 | 1.14 |
| Comparative example 1 | 0.80 | 0.82 | 0.83 | 0.85 | 0.86 | 0.86 | 0.90 | 0.98 | 1.06 |
| Comparative example 2 | 0.86 | 0.99 | 1.12 | 1.23 | 1.56 | 1.62 | 1.82 | 1.96 | 2.02 |
| Comparative example 3 | 0.82 | 0.98 | 1.23 | 1.31 | 1.54 | 1.59 | 1.78 | 1.86 | 2.01 |
| Comparative example 4 | 0.81 | 0.89 | 1.19 | 1.23 | 1.42 | 1.59 | 1.85 | 1.96 | 2.12 |

TABLE 3

Changes in lead connection resistances resulting from exposure to 80° C. and relative humidity of 85%

| Sample | Lead connection resistance (unit: mV/10 A) | | | | | | | | |
|---|---|---|---|---|---|---|---|---|---|
| Number of days | Initial value | 1 | 2 | 3 | 4 | 5 | 7 | 10 | 15 |
| Embodiment 1 | 0.79 | 0.85 | 0.93 | 0.98 | 1.06 | 1.12 | 1.23 | 1.32 | 1.38 |
| Embodiment 2 | 0.81 | 1.12 | 1.32 | 1.42 | 1.63 | 1.84 | 1.97 | 2.23 | 2.43 |
| Embodiment 3 | 0.83 | 1.26 | 1.54 | 1.86 | 2.06 | 2.56 | 2.95 | 3.35 | 3.62 |
| Comparative example 1 | 0.80 | 0.86 | 0.92 | 0.99 | 1.10 | 1.16 | 1.21 | 1.31 | 1.36 |
| Comparative example 2 | 0.90 | 1.02 | 1.21 | 1.96 | 2.68 | 4.21 | 6.78 | 15.43 | 28.33 |
| Comparative example 3 | 0.81 | 1.69 | 2.55 | 2.96 | 3.06 | 5.12 | 7.63 | 14.55 | 23.56 |
| Comparative example 4 | 0.81 | 1.59 | 3.22 | 3.65 | 4.89 | 6.21 | 8.55 | 16.24 | 25.12 |

Comparative example 1 is the conventional brush containing Pb. The brush of comparative example 2 is the same to the brush of comparative example 1 except that Pb is not added. The brush of comparative example 2 showed a significant increase in the lead connection resistance under the high humidity. It also showed an increase in the lead connection resistance at the high temperature. The tests were acceleration tests for obtaining results in a shorter time. Hence the exposure conditions, namely, humidity of 85% and temperature of 80° C. provided a severe temperature environment. In high humidity, however, the brush undergoes oxidization even at lower temperatures, and the lead connection resistance increases similarly after exposure over a long period. In the brush of comparative example 3, 2 wt % molybdenum disulfide was added to the lead side portion, and in the brush of comparative example 4, 3 wt %, respectively. Their lead connection resistances also increased greatly just like the brush of comparative example 2.

While the brush of embodiment 1 was subjected to a similar accelerated test, its lead connection resistance hardly increased. Thus a result similar to that of comparative example 1 was obtained. When the brushes of embodiment 2 and embodiment 3 were subjected to similar acceleration tests, their lead connection resistances increased a little more in comparison with embodiment 1, but the increases did not prevent the use of these brushes. Brushes of embodiments, which do not contain Pb but the metal sulfide solid lubricant, were able to prevent the increase in the lead connection resistances. The embodiments used the addition of molybdenum dissulfide as example, but the problem is generated by sulfur compounds such as copper sulfate, which are also generated by molybdenum disulfide, and the situation is identical when tungsten disulfide is added.

The invention claimed is:

1. A metal-graphite brush comprising a copper-graphite brush body into which a metal sulfide solid lubricant is mixed and a lead embedded in the copper-graphite brush body characterized in that a concentration of the metal sulfide solid lubricant in the copper-graphite brush body is made different between in a neighborhood of the lead in the copper-graphite brush body and a portion of the copper-graphite brush body with which a commutator of a rotational electric armature is to be in contact and a concentration of the metal sulfide solid lubricant in the neighborhood of the lead in the copper-graphite brush body is lower than a concentration of the metal sulfide solid lubricant in the portion of the copper-graphite brush body in contact with the commutator, wherein the concentration of the metal sulfide solid lubricant in the neighborhood of the lead in the copper-graphite brush body is less than 1 wt. %.

2. A metal-graphite brush of claim 1, characterized in that the concentration of the metal sulfide lubricant in the neighborhood of the lead in the copper-graphite brush body is substantially 0%.

3. A metal-graphite brush of claim 1, characterized in that the metal sulfide solid lubricant is at least a member of a group comprising molybdenum disulfide and tungsten disulfide.

4. A metal-graphite brush of claim 1, characterized in that the concentration of the metal sulfide solid lubricant in the portion of the copper-graphite brush body in contact with the commutator is from 1 to 5 wt. %.

5. A metal-graphite brush of claim 1, characterized in that the lead is a nonelectroplated copper lead.

6. A metal-graphite brush comprising a copper-graphite brush body to which a metal sulfide solid lubricant is added and a lead embedded in the copper-graphite brush body characterized in that a concentration of the metal sulfide solid lubricant in the copper-graphite brush body is made different between in a neighborhood of the lead in the copper-graphite brush body and a portion of the copper-graphite brush body with which a commutator of a rotational electric armature is to be in contact, a concentration of the metal sulfide solid lubricant in the neighborhood of the lead in the copper-graphite brush body is lower than a concentration of the metal sulfide solid lubricant in the portion of the copper-graphite brush body in contact with the commutator and the neighborhood of the lead in the copper-graphite brush body and the portion of the copper-graphite brush body in contact with the commutator are made of different powder materials in concentrations of the metal sulfide solid lubricant and shaped in a common mold, wherein the concentration of the metal sulfide solid lubricant in the neighborhood of the lead in the copper-graphite brush body is less than 1 wt. %.

7. A metal-graphite brush of claim 6, characterized in that said powder materials are further different in copper concentrations and that the copper concentration of the neighborhood of the lead is higher than the copper concentration of said portion.

* * * * *